US005505310A

United States Patent [19]

Marabini et al.

[11] Patent Number: 5,505,310

[45] Date of Patent: Apr. 9, 1996

[54] 2-MERCAPTO-BENZOXAZOLE DERIVATIVES AS COLLECTORS FOR THE SELECTIVE FLOTATION OF METAL ORES

[75] Inventors: Anna Marabini; Giorgio Bornengo; Vittorio Alesse; Fabrizio Bergamini, all of Rome, Italy

[73] Assignee: Consiglio Nazionale delle Ricerche, Rome, Italy

[21] Appl. No.: 244,254

[22] PCT Filed: Nov. 24, 1992

[86] PCT No.: PCT/IT92/00148

§ 371 Date: Jul. 15, 1994

§ 102(e) Date: Jul. 15, 1994

[87] PCT Pub. No.: WO93/10903

PCT Pub. Date: Jun. 10, 1993

[30] Foreign Application Priority Data

Nov. 27, 1991 [IT] Italy ..... RM91A0897

[51] Int. Cl.[6] ..... B03D 1/012; B03D 1/02; B03D 1/06

[52] U.S. Cl. ..... 209/166; 252/61

[58] Field of Search ..... 209/166, 167, 209/901; 252/61

[56] References Cited

U.S. PATENT DOCUMENTS

| | | |
|---|---|---|
| 1,780,000 | 10/1930 | Bolton . |
| 1,801,318 | 4/1931 | Moses et al. . |
| 4,511,464 | 4/1985 | Bergman . |
| 4,724,072 | 2/1988 | Bornengo . |
| 4,851,037 | 7/1989 | Bornengo . |
| 5,120,432 | 6/1992 | Bornengo . |

FOREIGN PATENT DOCUMENTS

| | | |
|---|---|---|
| 3613277 | 10/1986 | Germany . |

*Primary Examiner*—Thomas M. Lithgow
*Attorney, Agent, or Firm*—Beveridge, DeGrandi, Weilacher & Young

[57] ABSTRACT

A process for the selective flotation of at least one sulfide selected from the group of copper sulfide, silver sulfide, and activated zinc sulfide performed in the presence of 2-mercapto-benzoxazole derivatives.

21 Claims, No Drawings

2-MERCAPTO-BENZOXAZOLE DERIVATIVES AS COLLECTORS FOR THE SELECTIVE FLOTATION OF METAL ORES

This invention concerns the use of 2-mercapto-benzoxazole derivatives as collectors for the selective flotation of metal ores, as well as the related flotation process. More particularly, this invention relates to the selective flotation of those ores which are substantially in form of sulphides, to separate materials containing copper, zinc and silver.

As known in the art, flotation techniques use the selective activity of some special reagents on the various mineral components in order to separate one of said components or to provide an enrichment of the product in one of such components. The reagents employed for this purpose are commonly referred to as flotation "collectors", or "collecting agents" (or "collection agents").

The known or used collectors of the existing art are classified in two main classes, depending upon their ionic or nonionic nature. The use of non-ionic oily or neutral collectors is generally restricted to the flotation of non polar minerals, whilst the ionic collectors are used for all the other ore types. The ionic collectors are absorbed on the ore surface through an essentially chemical bond.

The conventional collectors suitable for the sulphide mineral flotation are mercaptan-based (i.e. thiol type) compounds and, among them, xanthates are the most widespread. However, such agents are effective on the whole sulphide class, without showing any specific selectivity within the said class.

While in most cases this property does not involve any problem, in some specific cases the composition of the ore to be treated is such that the use of modifying compounds is needed to make the collecting activity more specific.

Actually, the ore could contain a number of different commercially valuable sulphides forming an intimate admixture with each other and with the gangue, and each one of said sulphides could be present in such amount as to justify its recovery. For example, this occurs with complex sulphide ores consisting of intimate associations of chalcopyrite ($CuFeS_2$), sphalerite (ZnS) and galena (PbS) into a pyrite matrix, which associations could also contain a valuable amount of silver and, in some cases, of gold.

The use of modifiers often causes strong problems without giving the desired results, particularly when treating ores of a complex composition, whose surface features are not sufficiently defined.

It is clear from the foregoing that the use of collectors capable of bonding given sulphides in a selective way with respect to other sulphides would be highly recommended in some cases. The use of such collectors would limit the inclusion of undesired materials, thus resulting in higher recoveries of the desired metal(s), at higher concentrations.

According to this invention, it has been found that a class of mercapto-benzoxazole compounds shows superior selectivity in sulphide mineral flotation, thus affording effective separation between minerals of this category.

Compounds generically belonging to the class of mercapto-benzoxazoles are known, and are proposed as collecting agents in U.S. Pat. No. 1,801,318. The latter, however, does not suggest that the compounds disclosed may be active on some kinds of sulphides only, while being inactive on the others.

Compounds having some analogy with the compounds of this invention, specifically some mercapto-benzothiazole derivatives, are disclosed in Italian patent 1,181,890 (corresponding, e.g., to DE-A-3 613 277) as used in the selective flotation of lead and zinc ores. Such disclosure generically refers to both oxide and sulphide ores and evidences the ability of mercapto-benzothiazoles to separate lead ores, such as galena (PbS),from zinc ores,such as sphalerite (ZnS),by selectively floating the former with respect to the latter. To this regard it should be noted that, according to the known art, zinc can be floated only when previously activated by treatment with copper sulphate, in order to enrich the ore particle surface in copper salts.

However, the mercapto-benzothiazole-based collectors showed a comparable effectiveness, for instance, in selectively floating chalcopyrite ($CuFeS_2$), and consequently they cannot be used to separate the latter from galena when raw ores comprising both materials are to be treated.

On the contrary, the mercapto-benzoxazole derivatives of this invention have the ability to float sulphides of copper and silver, as well as zinc sulphides that have been previously properly activated, but they are unable to float lead and iron sulphides, nor zinc sulphides that have not been previously activated. It is evident that such ability allows To obtain single-metal concentrates by flotation also when starting from complex sulphides, without needing to use any modifier.

Therefore, the present invention specifically provides the use of 2-mercapto-benzoxazole derivatives of the formula:

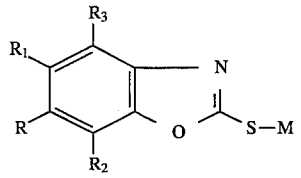

wherein:

one of R and $R_1$ is an alkyl group with 1–9 carbon atoms, the other being hydrogen; $R_2$ and $R_3$ are hydrogen; and M is H, Na, K, Li, Cs or $NH_4$; as collectors for the selective flotation of sulphide ores, for the separation by flotation of minerals containing copper and/or silver, and/or for the separation of previously activated zinc sulphide minerals, from other sulphides.

The collectors of this invention are advantageously employed to process materials containing chalcopyrite ($CuFeS_2$), corellite (CuS), chalcocite ($Cu_2S$), sphalerite (ZnS), galena (PbS), pyrite ($FeS_2$), silicate and/or carbonate-based gangues and mixtures thereof.

As the collectors of this invention float copper sulphides but do not float iron or lead sulphides, nor the not previously activated zinc sulphides, a separation of the various desired components from raw ores comprising complex sulphides could be obtained by recovering copper as a first step, by means of the collector of this invention, followed by a lead recovery, using the collectors of the existing art, and then by a zinc recovery, after having activated the remaining slurry with copper sulphate. For instance, this procedure could be satisfactorily used to process ores comprising chalcopyrite in a mixture with galena and sphalerite, together with pyrite and other gangues, when it is desired to recover all of the first three named minerals. In this case, the use of the mercapto-benzotiazole derivatives of the prior art as collecting agents would not afford the desired separation of chalcopyrite from galena.

Moreover, when the ore to be processed comprises an appreciable silver amount, the collectors of this invention allow, because of their selectivity for silver, to recover silver in the floating material, together with the copper compounds, if any.

The collectors of this invention can also be used in a mixture with other conventional collectors, such as xanthates, as well as with the zinc activators, if any, in order to obtain a bulk concentrate, e.g. a concentrate of copper, lead and zinc minerals.

The process using the collectors of this invention is particularly efficient when carried out at a pH range from 4 to 12, particularly from 6 to 10, by using the collector at a rate of 10 to 200 mg per kg of the ore to be floated. In such conditions the metal recovery is close to 100%.

The mercapto-benzoxazole compounds of this invention have an alkyl chain linked to the benzoxazole ring, at the 5- or 6-positions. Said chain provides the molecule with some hydrophobic character, which is advantageous in the flotation process. Actually, besides being an organic chelating agent, a flotation collector must also provide an adequate hydrophoby level, in order to facilitate the flotation of the ore particles which it bonds during the process.

However, the balance between chelating and hydrophobic properties must be such as to avoid any ore particle erosion due to a too strong bonding of the collector on the mineral surface. It is clear that the various features that a collector must have in order to perform its selective activity are strictly depending upon the nature of the ore to be floated.

The methods for preparing some of the collectors of this invention are described in the following examples, which are intended for the purpose of illustration only.

EXAMPLE 1

Preparation of a collector having the following formula:

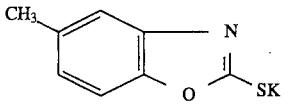

22 parts of (85%) potassium hydroxide was added dropwise to 90 parts of water. 12.3 parts of para-methyl-ortho-aminophenol was then added at room temperature. Stirring was carried out for 1 hour at 25° C., then 8.36 parts of carbon sulphide was added dropwise. Stirring was carried out for 2 hours at 25° C., followed by heating at 45° C. The mixture was allowed to react for 2 hours. The development of the reaction was monitored by chromatography on a silicagel thin layer, with 8:2 by volume, normal exane/ethyl acetate mixture as eluent (the salt-free product obtained by treatment with acetic acid showed a Rf=0.4).

When the reaction was completed, the product was filtered and the mother liquor was removed from the precipitated product on the filter, using 20 parts of methyl alcohol. The product was dried in oven under vacuum at appr. 50° C., obtaining finally 18.4 parts of dried raw material.

2 g of such product was dissolved in water and its pH was adjusted to 5, using acetic acid, providing 1.6 g of:

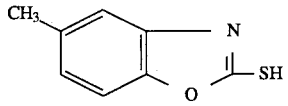

which is insoluble in the medium. The product obtained is unitary when analyzed by TLC, and has a melting point 216.5°–217° C.

Based on the above data, the purity of the technical product is 80%.

EXAMPLE 2

Preparation of a collector having the following formula:

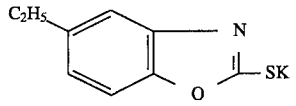

To 300 parts of 95% ethanol 41.1 parts of 4-ethyl-2-aminophenol was added, as well as 45 parts of water and 52.8 parts of potassium ethyl-xanthate. The mixture was refluxed for 3 hours and the solvent was distilled off when the reaction was completed. The solid product was treated with 50 parts of acetone, then filtered, and the solid product was treated again with 30 parts of acetone.

Finally, the material was dried in a vacuum oven at 50° C., giving 52.2 parts of the dried product. The HPLC analysis of the final product showed a 78% titer.

EXAMPLE 3

Preparation of a collector having the following formula:

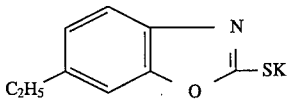

30 parts of (85%) potassium hydroxide was added to 30 parts of water. 15.3 parts of 2-amino-5-etoxyphenol was added at room temperature. Stirring was carried out for 1 hour at 25° C., then 8.6 parts of carbon sulphide was added dropwise in 40 minutes. The mixture was heated at 45° C. for 2 hours, then the reacted product was filtered, and the mother liquor was removed from the precipitated product with 50 parts of 10% brine.

The product was dried in a vacuum oven at 50° C. yielding 19.5 parts of dried product.

The HPLC analysis showed a 87.2% titer.

A small amount of the product, which was dissolved in water and treated with acetic acid at pH of about 5, precipitated. After filtration and drying, the salt-free product showed 214° C. as melting point.

Flotation Tests

The properties of the compounds according to this invention in the selective flotation of ores essentially comprising sulphides are shown in the following practical examples.

The general conditions of the flotation tests, as described in the examples, were as follows:

Grinding: from a fractured material which was granulated to a size lower than 3 mm, a 900 g sample was picked up, placed into a laboratory rod mill together with 900 g of mains water and the mixture was ground for a time sufficient to reduce 90% of the sample to sizes able to release the useful minerals; then the sample was extracted and diluted with 2 liters of water.

Flotation: the sample was introduced into the 2 liter cell of a Denver flotation equipment, and was stirred by the equipment rotor. While keeping the air inlet valve closed, one of the collectors under test was added and allowed to condition for 2 minutes. Thereafter, a foaming agent (frothing agent) was added. At the end of the conditioning time, during which the pH was continuously controlled, the air suction valve was opened and the rotor speed was adjusted to 1200 r.p.m., thus providing a foam carrying the mineral. The foam was removed by a hand shovel until exhaustion thereof, or, in case of persistency, till the complete removal of the mineral from the foam. Methyl-isobuthylcarbinol (MIBC) was used as foaming agent in all of the tests reported below.

EXAMPLE 4

In order to carry out a comparative test between the compound of Example 1 and a conventional collector, i.e. potassium amylxanthate, the test was carried out on a raw ore which is currently treated with said known collector, in order to recover copper therefrom.

Raw material analysis: Cu 0.65%, substantially as chalcopyrite; Pb 2%, substantially as galena; Zn 5.2%, substantially as sphalerite; Fe 35.2%, substantially as pyrite;
Flotation granulometry: d 80 43 μm;
Collector: potassium amylxanthate; 80 mg/kg, pH 7

| | Weight (%) | Cu (%) | Recov.'d Cu (%) |
|---|---|---|---|
| Floating material | 25.15 | 2.11 | 73.5 |
| Waste | 74.85 | 0.25 | 26.5 |

Collector: as per Example 1; 80 mg/kg, pH 7

| | Weight (%) | Cu (%) | Recov.'d Cu (%) |
|---|---|---|---|
| Floating material | 7.65 | 7.14 | 73.9 |
| Waste | 92.35 | 0.21 | 26.1 |

From the above results it may be noted that, at the same recovery rate, the Cu contents of the flotation product obtained according to this invention is more than 3 times that obtained using the prior art product.

EXAMPLE 5

A comparative test as the previous one was carried out on a raw material having the same composition, but with coarser granulometry.

Flotation granulometry: d 80 56 μm;
Collector: potassium amylxanthate; 80 mg/kg, pH 9.

| | Weight (%) | Cu (%) | Recov.'d Cu (%) |
|---|---|---|---|
| Floating material | 15.04 | 3.06 | 66.0 |
| Waste | 84.96 | 0.28 | 34.0 |

Collector: as per Example 1; 80 mg/kg, pH 9

| | Weight (%) | Cu (%) | Recov.'d Cu (%) |
|---|---|---|---|
| Floating material | 9.57 | 5.04 | 66.5 |
| Waste | 90.43 | 0.27 | 33.5 |

Also in this case it may be noted that, at the same recovery rate, the collector of this invention provides a higher Cu enrichment. Furthermore, the above data show the importance of the mineral releasability, which is associated to the ground granule size.

EXAMPLE 6

In order to illustrate the properties of the collectors of the closest prior art, i.e. mercapto-benzothiazoles, the results of two flotation tests with 6-propyl-mercapto-benzothiazole are summarized below.

Flotation granulometry: d 80 100 μm;
Collector: 6-propyl-mercaptobenzothiazole; 40 g/t
Raw material A analysis: Cu 3.2% as chalcopyrite, associated with pyrite, quartz, dolomite and chlorite;

| | Cu contents (%) | Recovered Cu (%) |
|---|---|---|
| Floating material | 17 | 82 |

Raw material B analysis: Pb 2.2%, essentially as galena; Zn 5.7%, essentially as sphalerite, associated with pyrite, quartz, siderite, mica, calcite and dolomite;

| | Pb contents (%) | Recovered Pb (%) |
|---|---|---|
| Floating material | 14 | 85 |

The above results show that the mercapto-benzothiazole derivative is equally effective in the flotation of both chalcopyrite and galena. Therefore, as previously indicated, mercapto-benzothiazoles do not possess the necessary selectivity to effectively treat a raw ore comprising both the above-mentioned sulphides.

EXAMPLE 7

A mercapto-benzoxazole with an alkyl chain of 9 carbon atoms, i.e. 5-nonyl-mercapto-benzoxazole, was tested as selective flotation agent according to this invention, with the following results:

Raw material analysis: Cu 1.07%; Zn 2.49%; Pb 0.89%; Ag 23 ppm; pyrite;
Flotation granulometry: d 80 65 μm;
Collector: 5-nonyl-mercaptobenzoxazole, 110 g/t;

| | Weight (%) | Cu cont.'s (%) | Recov. Cu (%) | Ag cont.'s (ppm) | Recov. Ag (%) |
|---|---|---|---|---|---|
| Float. mat. | 19.09 | 4.31 | 76.62 | 54.29 | 44.62 |
| Residue | 80.91 | 0.49 | 36.89 | 19.00 | 66.18 |

As shown above, an appreciable amount of silver was recovered in the floating material, together with a considerable fraction of the copper ore.

EXAMPLE 8

The selective ability of the collectors of this invention in silver ore recovery is further illustrated in the following example.

Raw material analysis: Cu 1.18%; Zn 2.30%; Pb 0.87%; Ag 21 ppm, in a pyrite gangue;
Flotation granulometry: d 80 48 μm;
Collector: compound as per Example 1; 110 g/t;

| | Weight (%) | Cu cont.'s (%) | Recov. Cu (%) | Ag cont.'s (ppm) | Recov. Ag (%) |
|---|---|---|---|---|---|
| Float. mat. | 8.20 | 12.07 | 84.02 | 123 | 47.11 |
| Residue | 91.80 | 0.22 | 16.98 | 13 | 52.89 |

EXAMPLE 9

The possibility of separating by means of a sequence flotation not only copper, but also zinc, by using the collectors of this invention, is illustrated by the following experimental results. The process steps are described further on.

Raw material analysis: Cu 0.9%, essentially as chalcopyrite; Pb 0.63%, essentially as galena; Zn 9.83% as sphalerite; gangue consisting of pyrite, chlorite and silicates.

| | Weight (%) | Cu (%) | Pb (%) | Zn (%) | Zn recov. (%) |
|---|---|---|---|---|---|
| Cu product | 8.57 | 6.10 | | | |
| Pb product | 10.25 | | | | |
| Zn product | 25.42 | | | 31.78 | 81.83 |
| Waste | 55.76 | 0.17 | 0.14 | 2.0 | 11.54 |

The Cu ore flotation was carried out at neutral pH, using the derivative of Example 2 as collector. From the resulting slurry the lead ore was separated by a further flotation, after having raised the pH, using a conventional collector, such as potassium amylxanthate.

After flotation of the Cu and Pb materials, the slurry had a pH 9.9. Then 300 g/t of $CuSO_4$ was added, in order to activate the zinc sulphide flotation, and the mixture was allowed to react under stirring for 5 minutes; thereafter, lime wash was added to adjust the pH to 10.3. The of Example 2 was added at a rate of 80 g/t. This mixture was allowed to react for 2 minutes and, following the foaming agent addition, a 5 minutes flotation was carried out.

As showed by the results in the foregoing table, the treatment allowed to recover 81.83% of the original zinc contents, besides recovering copper and lead sulphides.

EXAMPLE 10

Another advantageous use of the collecting agents of this invention is for recovering zinc from the residues of the Cu and Pb separation, irrespective of how said minerals were separated.

A feed of the kind previously described gave the following
Analysis: Cu 0.33%; Zn 2.5%; Pb 0.61%; Ag 22 ppm;
Activator: $CuSO_4$; 400 g/t; pH 12, using CaO;
Collector: compound of Example 1; 110 g/t

| | Weight (%) | Zn cont.'s (%) | Rec.'d Zn (%) |
|---|---|---|---|
| Floating material | 5.02 | 33.14 | 65.81 |
| Residue | 94.98 | 0.91 | 34.19 |

The present invention has been disclosed with specific reference to some preferred embodiments thereof, but it is to be understood that modifications and changes can be brought to it by those who are skilled in the art without departing from its true spirit and scope.

We claim:

1. A process for the selective flotation of at least one sulphide selected from the group consisting of copper sulphide, silver sulphide, activated zinc sulphide, and mixtures thereof from at least one member selected from the group consisting of lead sulphide, iron sulphide, non-activated zinc sulphide, and mixtures thereof contained in sulphide ores, comprising subjecting said sulfide ores to flotation in the presence of an effective amount of one or more collectors having the formula:

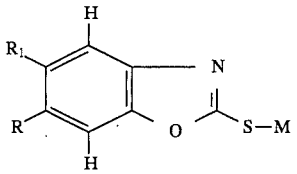

one of R and $R_1$ is an alkyl group with 1–9 carbon atoms, the other being hydrogen; and M is H, Na, K, Li, Cs or $NH_4$; wherein the resulting flotation float product contains said at least one sulphide selected from the group consisting of copper sulphide, silver sulphide, activated zinc sulphide, and mixtures thereof, and to thereby separate said flotation float product from at least one member of the group consisting of lead sulphide, iron sulphide, non-activated zinc sulphide, and mixtures thereof.

2. Process according to claim 1, wherein said sulphide ores contain chalcopyrite ($CuFeS_2$), covellite (CuS), chalcocite ($Cu_2S$), sphalerite (ZnS), galena (PbS), pyrite ($FeS_2$), silicate- and/or carbonate-based gangues or mixtures thereof.

3. Process according to claim 1, wherein said floatation float product is a mixture of copper sulphide and silver sulphide or said flotation float product is activated zinc sulphide.

4. Process according to claim 1, wherein said collector contains other activating agents.

5. Process according to claim 4, wherein said flotation float product is a mixture of copper sulphide and silver sulphide or a mixture of copper sulphide, silver sulphide and activated zinc sulphide.

6. Process according to claim 1, further comprising carrying out said process at a pH between 4 and 12.

7. Process according to claim 6, wherein said pH is between 6 and 10.

8. Process according to claim 1, wherein said amount is between 10 and 200 mg per kg of said ore.

9. Process according to claim 2 wherein said flotation float product is a mixture of copper sulphide and silver sulphide or said flotation float product is activated zinc sulphide.

10. Process according to claim 2, further comprising carrying out said process at a pH between 4 and 12.

11. Process according to claim 3, further comprising carrying out said process at a pH between 4 and 12.

12. Process according to claim 10, wherein said pH is between 6 and 10.

13. Process according to claim 11, wherein said pH is between 6 and 10.

14. Process according to claim 2, wherein said amount is between 10 and 200 mg per kg of said ores.

15. Process according to claim 3, wherein said amount is between 10 and 200 mg per kg of said ores.

16. Process according to claim 4, wherein said amount is between 10 and 200 mg per kg of said ores.

17. Process according to claim 5, wherein said amount between 10 and 200 mg per kg of said ores.

18. Process according to claim 6, wherein said amount is between 10 and 200 mg per kg of said ores.

19. Process according to claim 7, wherein said amount is between 10 and 200 mg per kg of said ores.

20. Process according to claim 1, further comprising recovering said resulting flotation float product.

21. A process for the selective flotation of sulfides contained in sulphide ores, (a) comprising subjecting said sulfide ores to a first flotation in the presence of an effective amount of one or more collectors having the formula:

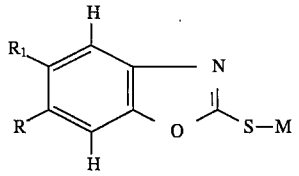

one of R and $R_1$ is an alkyl group with 1–9 carbon atoms, the other being hydrogen; and M is H, Na, K, Li, Cs or $NH_4$; wherein the resulting flotation float product contains copper sulphide and the flotation non-float product contains both lead sulfide and unactivated zinc sulfide, adding a lead collector to the flotation non-float product of said first flotation and subjecting said first flotation non-float product to a second flotation in the presence of said lead collector wherein the resulting flotation float product contains lead sulphide and the resulting non-float product contains unactivated zinc sulfide, adding a zinc activator to said second flotation non-float product to produce activated zinc sulphide, and subjecting said second flotation non-float product to a third flotation in the presence of said one or more collectors having the formula:

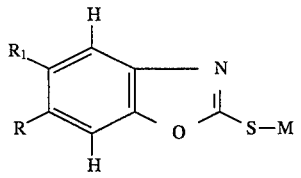

one of R and $R_1$ is an alkyl group with 1–9 carbon atoms, the other being hydrogen; and M is H, Na, K, Li, Cs or $NH_4$, wherein the resulting flotation float product contains activated zinc sulphide.

* * * * *